United States Patent [19]

Krulik et al.

[11] Patent Number: 4,762,601

[45] Date of Patent: Aug. 9, 1988

[54] COPPER BATH FOR ELECTROLESS PLATING HAVING EXCESS COUNTER-CATION AND PROCESS USING SAME

[75] Inventors: Gerald Krulik, Laguna Hills; Stephen C. Davis, Long Beach; John B. Davison, Mission Viejo, all of Calif.

[73] Assignee: Morton Thiokol, Inc., Chicago, Ill.

[21] Appl. No.: 929,242

[22] Filed: Nov. 10, 1986

[51] Int. Cl.[4] ..... B01D 13/02; C23C 18/16

[52] U.S. Cl. ..... 204/182.4; 204/DIG. 13; 204/130; 204/151; 106/1.23; 106/1.26; 427/345; 427/437

[58] Field of Search ..... 106/1.23, 1.26; 204/DIG. 13, 180.1, 182.3, 182.4, 130, 151; 427/345, 437

[56] References Cited

U.S. PATENT DOCUMENTS

| | | | |
|---|---|---|---|
| 3,754,940 | 8/1973 | Kadison et al. | 106/1.26 |
| 4,289,597 | 9/1981 | Grenda . | |
| 4,549,946 | 10/1985 | Horn | 204/182.4 |
| 4,600,493 | 7/1986 | Korngold | 204/301 |

OTHER PUBLICATIONS

G. Krulik et al., *Galvanotechnik* n. 11, V. 76 (1985) pp. 1806–1811.

H. Homma et al. *Japan Metal Finishing Technology* 34 Jan. 1984 pp. 47–52.

G. Krulik et al. *PC FAB* Aug. 1986, pp. 28–35.

F. A. Domino, *Plating of Plastics, Recent Developments* pp. 282–292 Noyes Data Corp., Park Ridge, N.J. 1979.

*Primary Examiner*—John F. Niebling

*Assistant Examiner*—John S. Starsiak, Jr.

*Attorney, Agent, or Firm*—Wayne E. Nacker; Gerald K. White

[57] ABSTRACT

An electroless copper plating bath is improved so as to facilitate its regeneration in an electrodialysis cell. The bath includes elevated amounts of an added salt, preferably as Na salt. The elevated sodium ion level serves as additional counter-cation to hydroxyl ion which is produced at the cathode of the electrodialysis cell. The excess anion from the added salt increases the rate of out-migration of by-products, such as formate ions and sulfate ions, relative to hydroxyl ions through an anion permselective membrane.

6 Claims, No Drawings

COPPER BATH FOR ELECTROLESS PLATING HAVING EXCESS COUNTER-CATION AND PROCESS USING SAME

The present invention is directed to electroless plating of copper. More particularly, the invention is directed to a plating bath which is more stable and more efficiently regenerated and to a process of using the copper bath in an electroless plating and regenerating cycle.

BACKGROUND OF THE INVENTION

Electroless plating is a process in which a metal, e.g., copper, is plated on a prepared surface in a non-electrolytic chemical process. In an electroless copper plating process, a bath is provided which includes: a cupric salt, e.g., cupric sulfate; a hydroxyl-containing compound, e.g., NaOH; a chelating ligand for cupric ion, e.g., sodium ethylenediaminetetraacetate (sodium EDTA) or 1, 1′, 1″, 1‴-(ethylenedinitrilo)tetra-2-propanol (Quadrol); and a reducing agent, such as formaldehyde. The surface to be plated is treated with a catalyst, whereupon exposure of the treated surface to the bath results in reduction of cupric ion to the zero valence state and deposition of metallic copper on the surface.

One typical prior art bath initially contains about 0.04 molar cupric sulfate, about 0.12 molar chelating agent, about 0.2 molar formaldehyde and about 0.3 molar sodium hydroxide. The pH is typically in the range of about 12–12.5, whereat copper plating in the presence of formaldehyde is near maximal efficiency, yet, the pH is not so high as to destabilize the bath. The components of the bath are initially provided in concentrations intended to optimize efficiency of plating, and it is attempted in the process of plating and electrodialysis to always maintain optimal concentrations in the bath, although this is probably unattainable.

U.S. Pat. No. 4,549,946 issued Oct. 29, 1985 to Horn, the teachings of which are incorporated herein by reference, describes in substantial detail several approaches to build-up of waste in a copper plating bath and replenishment of plating chemicals, beginning with a simple, but inefficient, bail-out system in which a portion of partially spent bath is discarded and appropriate chemical components are added to replenish the bath and going on to discuss various proposed methods of regenerating plating baths which involve less discard of chemicals.

A typical electroless plating bath is described in U.S. Pat. No. 4,289,597 issued Sept. 15, 1981 to Grenda, which bath contains cupric sulfate, NaOH, a chelating ligand (L) and formaldehyde. The cupric sulfate is the copper source; formaldehyde is the reducing agent; the chelating ligand maintains cupric ion in solution; and the sodium hydroxide provides hydroxyl ions which are consumed during copper reduction and also provides a high pH, i.e., in the range of about 11.5–13, whereat cupric reduction by formaldehyde is at near maximal efficiency. Because formaldehyde and cupric ions are consumed during cupric ion reduction, these chemical species must be replenished by addition to the bath. Excess sulfate ion, which builds up due to cupric sulfate replenishment, and formate ion, which is the oxidation product of formaldehyde, must be removed, or else the bath will show a progressive deterioration in its plating properties. Also, hydroxyl ion is consumed during cupric ion reduction and must be replenished. In a three-compartment electrodialysis cell described in the Grenda U.S. Pat. No. 4,289,597, the teachings of which are incorporated herein by reference, hydroxyl ions are gendrated in situ and supplied to the bath while excess sulfate ion and formate ion are removed from the; bath by electrodialysis.

The electrodialysis cell described in the Grenda patent comprises three compartments defined by two anionic permselective membranes, including (1) a cathode compartment containing an aqueous sodium hydroxide solution, (2) a center compartment containing partially spent copper plating bath and (3) an anode compartment containing waste chemicals, such as sulfuric acid. Copper bath, containing chelated cupric ions, formate ions, sulfate ions, and sodium ions, is continually recirculated between an electroless copper plating chamber and the center compartment of the electrodialysis cell. The electrodialysis cell replenishes the bath with hydroxyl ions and removes formate and sulfate ions from the bath.

The bath also contains carbonate ions which form from absorbed carbon dioxide. Carbonate ions are also removed by electrodialysis, and a "steady state" of carbonate ion concentration is generally achieved. For purposes of simplicity of discussion herein, carbonate ions are largely ignored.

The principle of the three-chamber dialysis cell is that hydroxyl ions are continuously generated at the cathode, and the anionic permselective membrane permits a substantially one-way flow of anions from the cathode compartment to the center compartment and from the center compartment to the anode compartment; hydroxyl ions flow from the cathode compartment to the center compartment, and hydroxyl, carbonate, sulfate and formate ions flow from the center compartment to the anode compartment. Cations, such as $Na^+$, are retained in the respective compartments by the anion permselective membranes. Attendant the generation of hydroxyl ions in the cathode compartment is the evolution of hydrogen. In the anode compartment, hydrogen ion is generated, oxygen is evolved, and some formate is oxidized to carbon dioxide, which is also evolved. Sulfate ions and formate ions remain in the anode compartment in the form of sulfuric acid and formic acid which are considered waste and must be removed. In the center compartment, there is a net replacement of sulfate and formate ions by the hydroxyl ions which are generated, in situ, in the cathode compartment. Accordingly, except for incidental loss, there is no need to replenish the bath with sodium hydroxide. The bath must be replenished by addition of copper sulfate and formaldehyde, but the excess sulfate and formate ions which build up during the plating process are continuously removed in the electrodialysis cell.

More sophisticated examples of electrodialysis cells of this type are described in above-referenced U.S. Pat. Nos. 4,549,946 and in 4,600,493 issued July 15, 1986 to Korngold, the teachings of which are incorporated herein by reference. The present invention is directed to the more efficient use of such electrodialysis cells.

The syntheses of $OH^-$ and $H^+$ ions (electrolysis of water) are essentially 100% electrically efficient. The, point of issue is the net efficiency of $OH^-$ regeneration to the plating bath. This is defined as that proportion of the total $OH^-$ synthesis which migrates to and then remains in the center or electroless copper bath compartment. It is appreciated that 100% of the total $OH^-$ synthesis is always transferred across the anion permselective membrane from the catholyte to the electroless copper bath (center) compartment. Because cations are not simultaneously transferred, in order to preserve electrical charge-balance, a correspondingly equal flux of anions must transfer from the electroless copper bath compartment thru the second anion permselective membrane to the anolyte. An equimolar amount of $H^+$ ion is simultaneously synthesized in the anode compartment relative to the $OH^-$ ion synthesis in the cathode compartment.

The anions able to transfer to the anolyte are $SO_4^=$, $HCO_2^-$, $CO_3^=$, and $OH^-$. If a large proportion of $OH^-$ ions transfer to the anolyte, the net efficiency of $OH^-$ regeneration is low. It is the purpose of this invention to retard the transfer of $OH^-$ ions from the bath relative to other anions and thus increase the net $OH^-$ efficiency of $OH^-$ regeneration.

SUMMARY OF THE INVENTION

The present invention provides an electroless copper plating bath which is particularly formulated and maintained in a system in which the bath is continuously recycled between a plating chamber and a three-compartment electrodialysis cell in which an anode compartment, a center bath-containing compartment and a cathode compartment are separated by anion permselective membranes. The plating bath comprises cupric sulfate (or other cupric salt) as the source of copper; formaldehyde as a reducing agent; a chelating agent, such as EDTA or Quadrol, to maintain cupric ion in solution; and a hydroxide of a non-copper cation, preferably an alkali metal hydroxide, in an amount sufficient to promote efficient reduction of cupric ion to metallic copper by formaldehyde. As an improvement to the prior art, the bath within the plating chamber further comprises a counter-cation, e.g., sodium, in excess of that added as the hydroxide for the purpose of maintaining the desired excess, i.e., a 0.2 to about a 2 molar equivalent per liter excess. The excess counter-cation is initially, for example, provided as an added salt, e.g., as a sulfate or as a formate. During electrodialysis of recirculating bath, the cations serve as counter ions to hydroxyl anions which are produced in situ at the cathode and which pass from the cathode compartment to the center compartment through the anion permselective membrane and further counter elevated concentrations of non-hydroxyl anions. The anion of the added salt, e.g., formate or sulfate, increases the relative proportion of non-hydroxyl anions in the center, compartment of the electrodialysis cell, resulting in a relatively higher proportion of non-hydroxyl anions and a relatively lower proportion of hydroxyl anions passing from the center compartment through the anion permselective membrane to the anode compartment. Through use of such a bath, hydroxyl ion regeneration to the bath and waste anion removal from the bath is enhanced relative to the wasteful process of hydroxyl migration to the anolyte.

In accordance with the method of the present invention, a copper plating bath having excess non-copper counter-cation and elevated concentrations of non-hydroxyl anions is used for copper plating and is continuously recirculated through the center compartment of an electrodialysis cell.

DETAILED DESCRIPTION OF THE PREFERRED EMBODIMENT

The present invention is directed to electroless copper plating in conjunction with electrodialysis apparatus, such as that described in referenced U.S. Pat. No. 4,289,597 and preferably advanced electrodialysis apparatus such as that described in referenced U.S. Pat. No. 4,600,493.

The electroless plating bath initially comprises cupric sulfate, a copper-chelating agent, such as EDTA or Quadrol, an alkali metal hydroxide, such as NaOH, and formaldehyde as a reducing agent for cupric ion. In the presence of a catalyst which is provided at the surface of material to be plated, reduction of cupric ion ($Cu^{++}$) to metallic copper $Cu^o$ takes place according to the formula:

$$CuSO_4+2H_2CO+4NaOH \rightarrow Cu^o+2H_2O+2HCO_2.Na+Na_2SO_4+H_2.$$

Thus, for each mole of metallic copper plated, two moles of formaldehyde and four moles of hydroxide are consumed. Also, sodium sulfate and sodium formate are produced.

Electrodialysis cells, as described above, through which the plating bath is continuously recirculated, enhance the efficiency of electroless copper plating by replenishing the hydroxyl ions consumed by the plating reaction and by continuously removing formate and sulfate ions from the bath, which if allowed to build up to excess concentrations, would destabilize the bath. Formaldehyde and cupric sulfate are replenished by addition to the bath, e.g., in the form of an aqueous concentrate.

The major electrolytic reaction of the electrodialysis cell for regenerating electroless plating solution is the electrolysis of water. The half reaction which occurs at the cathode, i.e., $2H_2O+2e^- \rightarrow H_2+2OH^-$, is required for producing, in situ, the hydroxyl ions which replenish the bath. The half-reaction at the anode, i.e., $2H_2O \rightarrow 4e^-+O_2+4H^+$ represents the balancing half-reaction which produces hydrogen ions. The hydrogen ions produced at the anode charge-balance the anions which migrate from the center compartment, neutralizing hydroxyl ions and forming sulfuric acid and formic acid. A minor half-reaction at the anode is the oxidation of formate: $HCO_2^- \rightarrow 2e^-+CO_2+H^+$, although most of the formate is disposed of as waste.

The degree to which undesirable hydroxide ion migration to the anode compartment occurs relative to desirable formate ion and sulfate ion migration depends upon the relative amounts of the several anions in the bath available for migration from the center compartment to the anode compartment. Ideally, but unobtainably, only sulfate and formate ions, but not hydroxyl ions, would migrate from the center compartment to the anode compartment at the rate at which hydroxyl ions are generated at the cathode and migrate from the cathode compartment to the center compartment. In reality, hydroxyl ion migrates from the center compartment to the anode compartment along with formate and sulfate. The present invention is directed to running a plating chamber and bath-regenerating electrodialysis cell in a manner that enhances formate and sulfate ion migration to the anode compartment relative to hydroxyl ion migration and thereby increases the efficiency of regeneration in the electrodialysis cell.

In considering relative migration of anions, it must be remembered that the cations and anions in each of the three compartments must remain substantially charge-balanced. Thus, hydroxyl anions may only be generated at the cathode at the rate at which hydroxyl ions migrate from the cathode compartment because the concentrations of counter-cations, i.e., $Na^+$, in the cathode compartment remains substantially constant, being retained by the anion permselective membrane. Likewise, in the center, bath-containing compartment, the cation concentrations are retained by the anion permselective membranes, requiring that the rate of hydroxyl ion in-migration from the cathode compartment be charge-balanced by anion out-migration to the anode compartment.

With respect to the relative rates of anion out-migration from the center compartment to the anode compartment, passage through the membrane is governed primarily by the laws of diffusion and to a lesser extent by electrostatic forces at the electrodes. As an approximation, the relative rate of out-migration of the several anions from the center compartment to the anode compartment is proportional to the relative concentrations of the several anions, including hydroxyl, sulfate, formate and carbonate in the bath within the center compartment.

If a plating bath were run without regeneration or replenishment, the hydroxyl concentration would decrease and the sulfate and formate concentrations would increase, slowing the rate of plating until it would eventually stop. If a plating bath were run without regeneration but with cupric sulfate, sodium hydroxide and formaldehyde replenishment, the build-up of impurities would cause poor copper plating and/or bath destabilization.

If an electrodialysis cell, such as that taught in referenced U.S. Pat. No. 4,289,597, were run with partially spent bath without recirculation from the plating chamber, the hydroxyl concentration in the center compartment would continually increase, more rapidly at first and then tapering off, while the sulfate concentration and the formate concentration would continually decrease, in like manner. This situation would eventually destabilize the bath due to build-up of an excessive concentration of hydroxide, including, e.g., NaOH and possibly $Cu(L)(OH)_2$.

In the case of continuous recirculation through the plating chamber and the electrodialysis cell, such as described in referenced U.S. Pat. No. 4,289,597 using a conventional bath in which sodium is added to the bath only in the form of sodium hydroxide in amounts sufficient to provide the requisite alkalinity and in which cupric sulfate and formaldehyde are continuously supplied as replenishment to the plating chamber, the hydroxyl ion concentration drops from its initial concentration to what might be considered a "steady state" or "equilibrium" concentration, while the sulfate concentration and formate concentration in the bath each rises due to the replenishment adds and lower rate of hydroxyl ion regeneration to the bath relative to by-product removal from the bath. Because the hydroxyl concentration is initially higher than either the total formate ion concentration or the sulfate ion concentration, the rate of hydroxyl ion migration from the center compartment to the anode compartment is greater than either the rate of sulfate migration or the rate of formate migration. As explained above, this high degree of hydroxyl ion out-migration is inefficient and counter to the desired goal of maintaining a high hydroxyl ion concentration in the recirculating bath. As the plating process consumes hydroxyl ions and generates formate ions and as continuous addition of cupric sulfate provides excess sulfate ions, the bath as a whole becomes somewhat depleted in hydroxyl ions and somewhat enriched in sulfate ions and formate ions relative to the initial concentrations of the several anions.

In accordance with the invention, a surprisingly more efficiently regenerable bath is provided by maintaining in the bath substantially higher concentrations of sodium ion (or other non-copper cation) than is required to achieve a desired level of alkalinity. This may be achieved by maintaining in the plating chamber relatively high concentrations of waste products, i.e., sodium formate and/or sodium sulfate. This is seemingly contradictory to the teachings of referenced U.S. Pat. No. 4,289,597 in that sodium formate and sodium sulfate destabilize the bath. However, while the levels of sodium formate and/or sodium sulfate are maintained at levels substantially above that of prior art baths, the level of each is maintained, through regeneration, well below the level whereat poor plating or destabilization occurs. At the same time, the added sodium formate and/or sodium sulfate substantially enhances the efficiency of bath regeneration in the electrodialysis cell.

The additional sodium sulfate and/or sodium formate (or other innocuous salts having non-copper cations) in the bath increases the non-copper cation ($Na^+$) concentration in the bath. The elevated level of sodium ion, relative to that necessary to serve as a counter-cation for the optimal level of hydroxyl ion (and, if necessary, chelating anions), provides additional counter-cation which is charged-balanced by a correspondingly elevated level of non-hydroxyl anions. The additional high cation and anion concentrations ensure that a greater proportion of hydroxyl ions, which in-migrate from the cathode compartment, are retained by the recirculating plating bath and not lost to the anode compartment.

The additional non-hydroxyl anion concentration, e.g., formate ion and/or sulfate ion, present in the center compartment of the electrodialysis cell enhances the relative out-migration of non-hydroxyl anions relative to out-migration of hydroxyl ions. Thus, when the concentration of formate and/or sulfate concentration in the center compartment is initially higher, the rate of sulfate ion and formate ion removal by the electrolysis cell is greater and the rate of hydroxyl ion regeneration in the center chamber is correspondingly greater. Because the sulfate and formate levels are maintained well below destabilization levels, there is no detrimental effects of concentrations of these anions which are higher than that taught or suggested by the prior art, and, surprising and-unexpectedly, maintaining these higher levels substantially enhances the rate of waste ion removal and hydroxyl ion regeneration.

While the invention is described above primarily in terms of a bath containing particular chemical species, it may be appreciated that various substitutions also embody the principles of the present invention. For example, although baths are discussed as employing sodium hydroxide to provide the necessary hydroxyl ion concentration to achieve a pH generally optimized for cupric ion reduction consistent with bath stability, it is appreciated that other bases, such as potassium hydroxide, could be substituted. Sodium hydroxide, however, is less expensive for a conventional system. Likewise, the excess non-copper cation need not be sodium, and might be substantially any cation, e.g., potassium, tetramethyl ammonium, etc., provided such cation would not plate out along with the copper or otherwise interfere with copper plating or with bath regeneration. Likewise, other non-hydroxyl anions than formate or sulfate would serve a similar purpose in the regeneration bath, enhancing the concentration of non-hydroxyl anions relative to hydroxyl anions and thereby enhancing the rate of hydroxyl ion regeneration in the bath. For example, $Cl^-$, $NO_3^-$, sulfamate, pyrophosphate, fluorobate and organic acids, such as acetate and lactate may be the additional non-hydroxyl anions.

When a higher level of formate and/or sulfate levels is maintained, particularly when the level of formate, sulfate or both is maintained above the hydroxyl ion concentration, the hydroxyl ion concentration may be maintained at or close to original hydroxyl ion concentrations by regeneration of the bath and may even increase. The goals, of course, are to maintain the hydroxyl ion concentration that achieves a pH within the plating chamber that promotes rapid reduction of cupric ion to metallic copper; to maintain bath stability throughout its recirculation loop, including within the plating chamber and within the electrodialysis cell; to maximize the rate of bath regeneration, i.e., the rate of replacement of formate and sulfate ions by hydroxyl ions, and to minimize the consumption of electricity for regeneration and purification.

Generally, in accordance with the invention, an electroless copper plating bath is maintained with a non-copper cation in excess of the concentration required as a counter-cation to the hydroxyl ion concentration that maintains a pH range that is generally optimized for copper reduction and bath stability in the plating chamber, whereby the excess non-copper cation serves as additional counter to hydroxyl ion that is regenerated in the electrodialysis cell. Correspondingly, non-hydroxyl anion is maintained in excess of that provided as a counter to cupric ion, e.g., sulfate, plus that which forms by oxidation of the reducing agent, e.g., formate.

Preferably, the excess cations and anions are initially added to the bath in the form of an appropriate salt or salts. e.g., sodium sulfate and/or sodium formate, so as to initially approach desired "equilibrium" concentrations of the several chemical species. Thereafter, levels of the several ionic species are maintained by appropriately adding chemicals to the plating bath and controlling the rate of bath regeneration in the electrodialysis cell. It is to be appreciated, however, that in a dynamic system, such as a recirculating plating/regenerating bath, the chemical species which are initially added to the fresh bath may be other than the salts which provide both the excess cations and anions. For example, the excess sodium (or other non-copper counter-cation) may be initially added as excess hydroxide, in which case, both initial plating rate and initial regeneration rate would be submaximal due to a higher initial pH, but similar "equilibrium" or "steady state" levels of various ionic species will eventually be achieved.

The entire volume of plating solution may properly be considered to be "the bath", as all of the solution is in recirculating communication; however, it is readily appreciated that the bath at various places in the cycle contains different concentrations of the various chemical species. Within the plating chamber, cupric sulfate and formaldehyde are continuously being added to sustain the plating reaction; in the dialysis cell, hydroxyl ions are continuously replenished and waste ions, e.g., formate and sulfate ions, are continuously removed. In such a dynamic system there can be no true equilibrium or steady state; however, in a well-controlled system, plating chemicals, i.e., cupric sulfate and formaldehyde, are added as nearly as practical, at a rate equal to the rate of their consumption; and under such conditions a "steady state" or "equilibrium" condition can be maintained.

For purposes of defining the dynamic, recirculating bath of the present invention, the bath as exists within the plating chamber is selected. Although this selection is somewhat arbitrary, it is appropriate because the primary purpose of the bath is, of course, to provide efficient and uniform copper plating. By maintaining bath conditions within the plating chamber within narrow parameters and operating the electrodialysis cell(s) under appropriate conditions, an "equilibrium" or "steady state" condition may be maintained with the concentrations of the several species remaining within generally narrow parameters.

In the plating bath according to the present invention, the cupric ion concentration, including cupric-ligand ion, is maintained at between about 0.01 and about 0.1 molar and preferably between about 0.03 and about 0.07 molar. The chelating ligand is maintained at between about 1.5 and about 3 and preferably between about 2 and about 2.75 molar equivalents of cupric ion concentration. (A molar equivalent of chelating agent is that necessary to chelate the cupric ion present.) The concentration of formaldehyde is maintained at between about 0.05 and about 0.75 molar and preferably between about 0.1 and about 0.2 molar. An hydroxyl ion concentration is maintained which achieves sufficient alkalinity to provide a pH of between about 11.0 and about 13 and preferably between about 11.5 and about 12.3. A non-copper cation is provided in sufficient concentration to serve as a counter-cation for the hydroxyl ion concentration which maintains the operational plating pH; also, an excess of between about 0.2 and about 2 molar equivalents per liter (calculated relative to $OH^-$) of non-copper cation is maintained above that required to counter the hydroxyl ion concentration that provides the desired plating pH. Preferably the excess of non-copper cation is between about 0.5 and about 1.0 molar equivalents per liter (calculated relative to $OH^-$). Non-hydroxyl anions, such as sulfate, carbonate and formate, are present at concentrations sufficient to charge-balance the bath.

For purposes of defining the invention, the excess non-cupric cation is defined herein as that above what is required as a counter to the hydroxyl ion concentration that provides the operational pH. However, those skilled in the art recognize that industry practice is not to control copper bath operation by pH, but rather by acid titration which gives a measure of the total operational alkalinity of the system, normally expressed as grams per liter of NaOH. This invention is defined by non-copper cation in excess of that needed to counter the hydroxyl ion concentration which provides the operational pH because the requisite operational alkalinity of the system varies according to the particular make-up of the bath.

Those skilled in the art recognize that actual formulations must be used to define the needed amounts of sodium hydroxide (or hydroxides of other non-copper cations) to achieve the requisite alkalinity of a working electroless copper bath, which is a buffered system with various salts and chelating ions that in conjunction with the added hydroxyl ion determine the pH. To initially provide a bath of conventional formulation, copper sulfate, chelating agent and formaldehyde are dissolved in appropriate concentrations. NaOH is added until the operational pH is achieved. The requisite amount of sodium hydroxide ion to achieve the operational pH is dependent upon the buffered nature of the bath. Copper sulfate, for example, is an acidic, slightly buffering salt, and some sodium hydroxide is required to overcome the acidic and buffering effects of cupric sulfate; if other cupric salts are used, a different amount of sodium hydroxide is required to counteract the effects of the salt. The choice of chelating agent also determines the amount of sodium hydroxide required to achieve the operational alkalinity and pH. EDTA, for example, is acidic, and is neutralized by four moles of sodium hydroxide; Quadrol, on the other hand is neutral. Accordingly, the operational alkalinity will vary for each particular bath; and therefore, the excess non-copper cation is defined herein as excess over that required as the hydroxide to attain the operational pH. In actually running a particular bath in accordance with this invention, an operational alkalinity which provides the operational pH is predetermined, and the copper bath is subsequently controlled according to the titrated operational alkalinity of the particular bath.

A recirculating system includes the copper plating bath and the electrodialysis cell or battery of cells and also provides means for recirculating bath from the plating chamber to the electrodialysis cell and from the electrodialyis cell to the plating chamber. The "steady state" concentrations sought in the process of operating the system are achieved by appropriate adjustment of several factors, including the rate of input of chemicals, such as cupric sulfate and formaldehyde, into the plating chamber, the rate at which bath is pumped between the plating chamber and the electrodialyis cell, the electrical power at which the electrodialysis cell or battery of cells is operated, the rate of plating in the chamber, e.g., as determined by the area of catalytically-treated surface in the plating chamber, etc. In running a dynamic system, the various factors must be regularly adjusted. The system requires that the concentrations of chemical species be monitored throughout the system and that the several factors be adjusted according to the monitored concentrations. A copper bath plating/regeneration system which is monitored and controlled by computer with feedback according to monitored concentrations of chemical species is described, for example, by G. A. Krulik, et al., Galvanotechnik n. 11, Volume 76 (1985) pp 1806–1811. Adjustment of the several factors may be continuous or intermittent, as is practical and is consistent with efficiency of the system. Thus although the invention is described in terms of relative concentrations of various chemical species, short-term excursions from these relative concentrations may occur in the process of operating the system without departing from the scope of the present invention.

The plating temperature preferably is maintained at about the 110° F. to 130° F. (43°–54°) range, more preferably in the 115° F. to 125° F. (46°–52° C.) range, although plating can be effected at temperatures well outside of these ranges, e.g., 70° F. to 150° F. (21°–66° C.).

The electrical parameters, e.g., potential, current and power, are dependent on the construction and number of the electrodialysis cells and will be varied, as required to maintain a "steady state" of the bath. Electrical parameters of electrodialysis cells are known in the art and are not considered part of this invention.

The anolyte and catholyte are recirculated from and to their respective compartments. Heat is generated at both electrodes, optionally requiring continuous cooling of both the recirculating anolyte and recirculating catholyte. Electrolysis enriches the anolyte in acid, e.g., sulfuric acid and formic acid, and anolyte must therefore be removed and replenished with water.

The invention will now be described in greater detail by way of specific examples.

EXAMPLE 1

Below is a comparison of an "old" bath formulated in accordance with the prior art with sufficient sodium hydroxide to achieve an operational pH and a "new" bath formulated in accordance with the present invention with sufficient sodium hydroxide to achieve the operational pH plus additional sodium added in the form of sodium sulfate to substantially enhance the efficiency of bath regeneration by electrolysis.

| | OLD | NEW |
|---|---|---|
| $CuSO_4.5H_2O$ | 12 gm/l | 12 gm/l |
| Quadrol | 35 gm/l | 35 gm/l |
| NaOH | 7 gm/l | 7 gm/l |
| Formaldehyde (37% solution) | 12 gm/l | 12 gm/l |
| $Na_2SO_4$ | — | 56 gm/l |

The old bath provides 0.175 mole per liter sodium; the new bath 0.96 mole per liter, a 0.789 mole per liter excess.

EXAMPLE 2

A small laboratory electrodialysis unit was run to determine the efficiencies of hydroxyl ion generation in a center compartment starting with different concentrations of sodium sulfate and over time. To simplify the system, the "bath" in the center compartment contained only sodium sulfate. The anolyte was maintained at a constant 0.1 normal sulfuric acid; the catholyte was 0.5N NaOH. The cells were rinsed with deionized water before each run, and a new solution of sodium sulfate was made up for each run. The cell pressure in each case was four pounds per square inch. Bath volume was 10 liters. Bath flow was 0.8 to 1.0 liter/min. Six cells were connected in series, and at a constant current of 23.5 amps, a current density of 125 miliamps per square centimeter was maintained. In each case "0" time is actually after a short run of varying current needed to bring the system up to operating current. Sodium hydroxide concentrations were titrated with HCl.

| TIME MIN. | VOLTAGE | °F. | NaOH gm/l | INCREMENTAL NaOH gm/hr | % EFFICIENCY |
|---|---|---|---|---|---|
| RUN 1 - 0.25 N sodium sulfate initially | | | | | |
| 0 | 58 | 88 | 0.52 | — | — |
| 10 | 53 | 92 | 2.32 | 108 | 51.4 |
| 20 | 49 | 97 | 3.48 | 69.6 | 33 |
| 30 | 56 | 102 | 4.36 | 52.8 | 25 |
| 40 | 57 | 105 | 5.00 | 38.4 | 18.3 |
| 50 | 58 | 108 | 5.56 | 33.6 | 16 |
| 60 | 58 | 111 | 5.88 | 19.2 | 9.1 |

-continued

| TIME MIN. | VOLTAGE | °F. | NaOH gm/l | INCREMENTAL NaOH gm/hr | % EFFICIENCY |
|---|---|---|---|---|---|
| 80 | 57 | 117 | 6.60 | 21.6 | 10.3 |
| Maximum possible NaOH at 100% conversion is 10 g/l | | | | | |
| RUN 2 - 0.50 N sodium sulfate initially | | | | | |
| 0 | 51 | 84 | 0.60 | — | — |
| 11 | 45 | 94 | 2.84 | 122.1 | 58.1 |
| 22 | 44 | 97 | 4.44 | 87.2 | 41.6 |
| 30 | 44 | 100 | 5.36 | 69.0 | 32.8 |
| 40 | 43 | 103 | 6.40 | 62.1 | 29.7 |
| 50 | 43 | 106 | 7.40 | 60.0 | 28.6 |
| 60 | 44 | 109 | 8.08 | 40.8 | 19.4 |
| 70 | 47 | 111 | 8.72 | 38.4 | 18.2 |
| 80 | 48 | 113 | 9.20 | 28.8 | 13.7 |
| 90 | 48 | 117 | 9.84 | 38.4 | 18.2 |
| Maximum possible NaOH at 100% conversion is 20 g/l | | | | | |
| RUN 3 - 0.75 N sodium sulfate initially | | | | | |
| 0 | 44 | 83 | 0.52 | — | — |
| 10 | 41 | 89 | 2.72 | 132 | 62.9 |
| 20 | 40 | 95 | 4.76 | 122.4 | 58.3 |
| 30 | 40 | 97 | 6.24 | 88.8 | 42.3 |
| 40 | 40 | 100 | 7.64 | 84.0 | 40.0 |
| 55 | 41 | 102 | 9.36 | 68.8 | 32.8 |
| 70 | 41 | 106 | 10.84 | 59.2 | 28.1 |
| 100 | 42 | 112 | 13.12 | 68.4 | 32.6 |
| 130 | 46 | 117 | 14.80 | 50.4 | 24.0 |
| 160 | 48 | 122 | 16.00 | 24.0 | 11.4 |
| Maximum possible NaOH at 100% conversion is 30 g/l | | | | | |
| RUN 4 - 1.0. N sodium sulfate initially | | | | | |
| 0 | 46 | 83 | 0.36 | — | — |
| 10 | 40 | 90 | 2.88 | 151.2 | 72.0 |
| 20 | 40 | 95 | 4.92 | 122.4 | 58.3 |
| 30 | 40 | 98 | 6.96 | 120.0 | 57.0 |
| 40 | 40 | 100 | 8.32 | 81.6 | 39.0 |
| 50 | 39 | 103 | 9.76 | 86.4 | 41.1 |
| 60 | 39 | 105 | 10.88 | 67.2 | 32.0 |
| 75 | 38.5 | 107 | 12.56 | 67.2 | 32.0 |
| 90 | 38 | 110 | 14.24 | 67.2 | 32.0 |
| 120 | 38.5 | 114 | 16.56 | 69.6 | 33.1 |
| 150 | 42 | 117 | 18.08 | 30.4 | 14.5 |
| Maximum possible NaOH at 100% conversion is 40 g/l | | | | | |

It can be seen that the higher the concentration of sodium sulfate, the greater efficiency of hydroxide generation. As time goes on, efficiency decreases as hydroxide replaces sulfate in the counter compartment, leading to a greater proportion of hydroxyl ion being lost to the anolyte.

EXAMPLE 3

Runs 5 and 6 were run in the same manner as Runs 1–4, but the current was 9 amps, providing a current density of 50 milliamps per cm². Again, the higher the concentration of sodium sulfate, both initally and over time, the higher the efficiency of OH⁻ production.

| TIME MIN. | VOLTAGE | °F. | NAOH gm/l | INCREMENTAL NaOH gm/hr | % EFFICIENCY |
|---|---|---|---|---|---|
| RUN 5 - 0.25 N sodium sulfate initially | | | | | |
| 0 | 37 | 77 | 0.28 | — | — |

-continued

| TIME MIN. | VOLTAGE | °F. | NAOH gm/l | INCREMENTAL NaOH gm/hr | % EFFICIENCY |
|---|---|---|---|---|---|
| 10 | 34 | 80 | 1.20 | 55.2 | 65.7 |
| 20 | 34 | 82 | 2.04 | 50.4 | 60.0 |
| 44 | 32 | 87 | 3.52 | 37 | 44.0 |
| 70 | 31.5 | 90 | 4.56 | 24 | 28.6 |
| 100 | 30 | 94 | 5.48 | 18.4 | 21.9 |
| 130 | 29 | 96 | 6.08 | 12 | 14.3 |
| 160 | 29 | 97 | 6.60 | 10.4 | 12.4 |
| 190 | 29 | 99 | 6.88 | 5.6 | 6.7 |
| 205 | 32 | 100 | 7.04 | 6.4 | 7.9 |
| 250 | 33 | 103 | 7.32 | 3.7 | 4.6 |
| Maximum possible NaOH at 100% conversion is 10 g/l | | | | | |
| RUN 6 - 1.0. N sodium sulfate initially | | | | | |
| 0 | 30 | 81 | 0.20 | — | — |
| 10 | 30 | 83 | 1.16 | 57.6 | 68.6 |
| 20 | 28 | 86 | 2.12 | 57.6 | 68.6 |
| 30 | 28 | 86 | 2.96 | 48 | 57.1 |
| 70 | 28 | 90 | 6.04 | 45.9 | 54.6 |
| 85 | 28 | 91 | 7.16 | 44.8 | 53.3 |
| 100 | 27 | 92 | 8.08 | 36.8 | 43.8 |
| 130 | 27 | 94 | 9.52 | 43.2 | 51.4 |
| 160 | 27 | 95 | 10.80 | 38.4 | 45.7 |
| 160* | 29 | 71 | 11.04 | — | — |
| 190 | 28 | 77 | 12.16 | 33.6 | 40 |
| 210 | 28 | 82 | 13.20 | 31.2 | 37.2 |
| 240 | 27 | 86 | 14.16 | 19.2 | 23.8 |
| 270 | 27 | 89 | 14.96 | 16.0 | 19.9 |
| 300 | 27 | 91 | 15.76 | 16.0 | 19.9 |
| 345 | 26 | 94 | 16.80 | 13.9 | 17.2 |
| Maximum possible NaOH at 100% conversion is 40 g/l | | | | | |

*After overnight shutdown and a short restart period.

EXAMPLE 4

Test baths were run in production electrodialysis cells to test the efficiency of OH⁻ regeneration with various amounts of excess sodium sulfate. To keep the system simple, the bath was not used for plating and therefore contained no formaldehyde. The initial cupric sulfate concentration in each case was 12 gm/l. The Quadrol concentration was 37 gm/l. Sodium sulfate was provided to achieve the specific gravities set forth in the Table below. The size of each bath was about 300 gal. Fifteen Copperstat TM cells were used, providing a total of 22,500 cm² active anion exchange membrane area. The cells were connected in series/parallel, i.e., five groups each of three cells in series were connected in parallel. The amperage was maintained at 600. Runs were for 90 to 105 min.

Results of these runs is set forth in Table 1 below.

TABLE 1

| BATH | SPEC. GRAV. | EXCESS Na⁺ gm/l | TOTAL TIME | START NaOH gm/l | FINISH NaOH gm/l | CHANGE NaOH gm/l | NaOH gm/l per hr. | % EFFICIENCY |
|---|---|---|---|---|---|---|---|---|
| 1 | 1.013 | 0.35 | 105 min. | 2.56 | 4.24 | 1.68 | 0.96 | 40.6% |
| 2 | 1.032 | 6.79 | 90 min. | 1.88 | 4.40 | 2.52 | 1.68 | 71.1% |
| 3 | 1.046 | 10.70 | 90 min. | 1.36 | 4.88 | 3.56 | 2.34 | 99.0% |

At 600 amps, theoretical 100% efficiency will produce 2686 gm/hr NaOH, or 2.37 gm/l/hr in a 1135 liter bath.

The same runs were recalculated, for only the period during which the NaOH changed from 3 to 4 gm per liter, which is a typical alkalinity maintained during electroless plating for this bath. The results are as follows:

| BATH | TIME | gm NaOH per hr | % EFFICIENCY |
|---|---|---|---|
| 1 | 70.8 min. | 962.7 | 35.8 |
| 2 | 37.4 min. | 1822.4 | 67.8 |
| 3 | 29.4 min. | 2350.3 | 87.5 |

The results show that the higher the concentrations of non-cupric cation and non-hydroxyl anion, the greater efficiency of an electrodialysis cell is achieved.

EXAMPLE 5

The increased efficiency of added sodium sulfate has been repeatedly demonstrated in actual plating/regeneration runs with formaldehyde-containing, operating electroless copper baths using between 15 and 30 electrodialysis cells connected in series/parallel. Good plating results are maintained.

While the invention has been described in terms of certain preferred embodiments, modifications obvious to one with ordinary skill in the art may be made without department from the scope of the present invention. For example, it is to be appreciated that although cupric sulfate is the preferred cupric ion source, other cupric salts, including cupric chloride, nitrate and acetate are suitable substitutes. In such case, excess amounts of the anion of the cupric salt could be added, e.g., as sodium salt, to promote more efficient regeneration of the bath. Likewise, other chelating agents, such as those described in U.S. Pat. No. 4,289,597 may be substituted for EDTA or Quadrol.

Various features of the invention are set forth in the following claims.

What is claimed is:

1. A process for electroless plating of copper onto catalyst-treated surfaces with a plating bath and continuously regenerating said plating bath, the process comprising providing a plating chamber wherein metallic copper is electrolessly deposited from a plating bath onto catalyst-treated surfaces, providing an electrodialysis cell comprising a cathode compartment having a cathode, a center compartment having no eIectrode, and an anode compartment having an anode, said cathode compartment being separated from said center compartment by an anion permselective membrane and said center compartment being separated from said anode compartment by an anion permselective membrane, said cathode compartment containing a basic aqueous solution, said center compartment containing partially spent plating bath, and said anode compartment containing an electrolyte, providing means for recirculating plating bath from said plating chamber to said center compartment of said electrodialysis cell and back to said plating chamber, maintaining within said plating chamber an aqueous plating bath comprising cupric ion at a concentration of between about 0.01 and about 0.1 molar, a chelating ligand for cupric ion at a concentration of between about 1.5 and about 3 molar equivalents of said cupric ion concentration, formaldehyde at a concentration of between about 0.05 and about 0.75 molar, an hydroxyl ion concentration sufficient to provide a pH of between about 11.0 and about 13, non-copper cation in sufficient concentration to serve as a counter-cation for said hydroxyl ion concentration plus an excess of non-copper cation of between about 0.2 and about 2 normal above that required to counter said hydroxyl ion concentration, and non-hydroxyl anions at concentrations sufficient to charge-balance said bath, said non-hydroxyl anions being of such type and concentration as to be consistent with efficient copper plating on catalyst-treated surfaces, recirculating plating bath between said plating chamber and said center compartment of said electrodialysis cell, and establishing a current between said cathode and said anode so to regenerate plating bath in said center compartment, replenishing said bath with hydroxyl ions and removing non-hydroxyl anions from said bath.

2. A process according to claim 1 wherein said non-copper cation is selected from the group consisting of sodium ion, potassium ion and mixtures thereof.

3. A process according to claim 1 wherein said excess of non-copper cation is at least about 0.5 normal.

4. A system for electroless plating of copper onto catalyst-treated surfaces with a plating bath and continuously regenerating said plating bath, the process comprising providing a plating chamber wherein metallic copper is electrolessly deposited from a plating bath onto catalyst-treated surfaces, providing an electrodialysis cell comprising a cathode compartment having a cathode, a center compartment having no electrode, and an anode compartment having an anode, said cathode compartment being separated from said center compartment by an anion permselective membrane and said center compartment being separated from said anode compartment by an anion permselective membrane, said cathode compartment containing a basic aqueous solution, said center compartment containing partially spent plating bath, and said anode compartment containing an electrolyte, providing means for recirculating plating bath from said plating chamber to said center compartment of said electrodialysis cell and back to said plating chamber, maintaining within said plating chamber an aqueous plating bath comprising cupric ion at a concentration of between about 0.01 and about 0.1 molar, a chelating ligand for cupric ion at a concentration of between about 1.5 and about 3 molar equivalents of said cupric ion concentration, formaldehyde at a concentration of between about 0.05 and about 0.75 molar, an hydroxyl ion concentration sufficient to provide a pH of between about 11.0 and about 13, non-copper cation in sufficient concentration to serve as a counter-cation for said hydroxyl ion concentration plus an excess of non-copper cation of between about 0.2 and about 2.0 normal above that required to counter said hydroxyl ion concentration, and formate and sulfate ions at concentrations sufficient to charge-balance said bath, recirculating plating bath between said plating chamber and said center compartment of said electrodialysis cell, and establishing a current between said cathode and said anode so as to regenerate plating bath in said center compartment, replenishing said bath with hydroxyl ions and removing non-hydroxyl anions from said bath.

5. A process according to claim 4 wherein said non-copper cation is selected from the group consisting of sodium ion, potasssium ion and mixtures thereof.

6. A process according to claim 4 wherein said excess of non-copper cation is at least about 0.5 normal.

* * * * *